US005565967A

United States Patent [19]

Ochiai et al.

[11] Patent Number: 5,565,967

[45] Date of Patent: Oct. 15, 1996

[54] METHOD OF FORMING IMAGE USING MAGNETIC DEVELOPER WITH HIGH VOLUME RESISTIVITY

[75] Inventors: Masahisa Ochiai, Fukaya; Tsutomu Saitoh; Masumi Asanae, both of Kumagaya, all of Japan

[73] Assignee: Hitachi Metals, Ltd., Tokyo, Japan

[21] Appl. No.: 498,603

[22] Filed: Jul. 6, 1995

[30] Foreign Application Priority Data

Jul. 7, 1994 [JP] Japan ..... 6-155619

[51] Int. Cl.[6] ..... G03G 15/08

[52] U.S. Cl. ..... 355/251; 118/657; 430/122

[58] Field of Search ..... 355/245, 251, 355/219, 271; 118/657, 658; 430/122

[56] References Cited

U.S. PATENT DOCUMENTS

| | | | |
|---|---|---|---|
| 5,294,967 | 3/1994 | Munakata | 355/326 R |
| 5,438,398 | 8/1995 | Tanigawa et al. | 355/271 |
| 5,463,450 | 10/1995 | Inoue et al. | 355/219 |

FOREIGN PATENT DOCUMENTS

| | | | |
|---|---|---|---|
| 0158078 | 10/1985 | European Pat. Off. | 355/251 |
| 57-130407 | 8/1982 | Japan . | |
| 59-905 | 1/1984 | Japan . | |
| 59-226367 | 12/1984 | Japan . | |
| 62-201463 | 9/1987 | Japan . | |

*Primary Examiner*—R. L. Moses
*Attorney, Agent, or Firm*—Morgan, Lewis and Bockius LLP

[57] ABSTRACT

An image forming method includes the steps of charging a surface of a movable image-bearing member uniformly by using a roller charging means, forming an electrostatic latent image on the image-bearing member by carrying out an image exposure, delivering a magnetic developer which is attracted onto a surface of a sleeveless permanent magnetic member to a developing region located opposite to the electrostatic latent image formed on the image-bearing member, the sleeveless permanent magnetic member being formed with a plurality of magnetic poles provided on its surface and having a cylinder shape, developing the electrostatic latent image using the magnetic developer comprising a toner and magnetic carriers, the magnetic carriers having a volume resistivity of $10^{10}$ Ω.cm or more, and transferring a toner image onto a transfer sheet by using a roller transfer means.

4 Claims, 1 Drawing Sheet

METHOD OF FORMING IMAGE USING MAGNETIC DEVELOPER WITH HIGH VOLUME RESISTIVITY

BACKGROUND OF THE INVENTION

1. Field of the invention

The present invention relates to an image forming method for employing a magnetic developer attracted on the surface of a developer conveying member comprising a permanent magnetic member formed like a cylinder to develop an electrostatic latent image formed on the surface of an image-bearing member that moves while bearing the image, and in particular, to an image forming method that can prevent magnetic carriers in the magnetic developer from attaching to the image-bearing member.

2. Description of the Related Art

In the most typical conventional image forming methods in printers and facsimile terminal equipment which are applications of electrophotography or electrostatic recording, an electrostatic latent image is formed on the surface of a photosensitive drum formed like, for example, a cylinder, and a developing roller disposed opposite to the photosensitive drum and comprising a built-in permanent magnetic member and a sleeve fitted and inserted into the roller so as to share the axis with the permanent magnetic member and to rotate relative to the member is then used to deliver a magnetic developer attracted on the surface of the sleeve. Thereafter, a magnetic brush is formed in a developing region and allowed to slide on the surface on which the electrostatic latent image is formed in order to brush the surface, thereby forming a visual toner image. The developed toner image is then transferred to a transfer sheet and then thermally fixed therein.

Conventional constructions also use as charging and transfer means corona charging generated by applying a high voltage (DC 5 to 8 kV) to metal (such as stainless steel or tungsten) wires. These methods, however, also generate corona products such as ozone and NOx when generating corona, and such products may give out an offensive smell to disrupt the environment. The corona products may also degenerate the surface of the photosensitive drum to facilitate the unsharpness or degradation of images, or contaminate the wires to affect the quality of the images, resulting in the presense of undesired white sections (non-image areas) or the presence of black stripes in the images.

Since the corona transfer method electrostatically transfers a toner image to a transfer sheet by applying corona charges of a polarity opposite to that of the developer against the rear surface of the transfer sheet, the resistance of the transfer sheet may be varied due to humidity, and transfer may be difficult if the sheet has a low resistance.

In addition, since only 5 to 30% of the supplied currents reach the photosensitive drum or transfer sheet with most of the currents diverted to a shield plate, the corona discharge method has a low power efficiency as a charging or transfer means. This method thus requires a large amount of power to be consumed to obtain a predetermined efficiency and also requires a high-voltage transformer of a large capacity.

To solve the above problems, image forming methods using a roller charging means and a roller transfer means have been provided.

There have recently been strong demands for smaller devices used for the above image forming methods, and the miniaturization of a developing section is becoming more and more important. Methods that cause a magnetic developer to directly attract to the surface of a permanent magnet member and then rotate the permanent magnet member to transfer the magnetic developer without using a sleeve have thus been proposed as means for meeting such demands (for example, Japanese Patent Laid Open No. 62-201463).

FIG. 1 describes the integral part of an example of the above sleeveless developing means. In this figure, a magnetic developer 2 mainly comprises, for example, toner and magnetic carriers is accommodated in a developer vessel 1, and a permanent magnetic member 4 installed rotatably at the bottom of the developer vessel 1. The permanent magnetic member 4 has at least its surface formed so as to be conductive, and is formed like a cylinder with a plurality of axially extending magnetic poles provided on its outer circumferential surface.

The permanent magnetic member 4 can be formed of a resin bonded magnet comprising a mixture of ferromagnetic powders and resin (see Japanese Patent Laid Open No. 57-130407, Japanese Patent Laid Open No. 59-905, Japanese Patent Laid Open No. 59-226367). The surface may be formed so as to be conductive by forming a conductive layer thereon by means of bonding or plating or adding a powder-like conductive substance during the kneading of the material. The permanent magnetic member 4 may be formed of a hard ferrite magnet so as to be semi-conductive.

An image-bearing member (a photosensitive drum) 3 is rotatably installed in the direction of the arrow in FIG. 1 and opposed to the permanent magnet member 4 with a gap (g) set between the members 3 and 4. A doctor blade 5 is attached to the developer vessel 1, and opposed to the permanent magnetic member 4 with a gap (t) set between the doctor blade 5 and the member 4 to adjust the thickness of the layer of magnetic developer 2 attracted on the surface of the permanent magnet member 4. A charging roller 6, a transfer roller 7, and a cleaning device 8 having a blade 9 is disposed opposite to the outer circumference of the image-bearing member 3. In addition, a bias voltage from the permanent magnet member 4 or a DC power supply (not shown) is applied to the magnetic developer 2 attracted on the permanent magnet member 4.

With the above configuration, when the image-bearing member 3, charging roller 6, permanent magnet member 4, and transfer roller 7 are respectively rotated in the direction shown by the arrow, the charging roller 6 uniformly charges the surface of the photosensitive drum 3. When the image-bearing member 3 is then exposed with an optical signal (not shown), an electrostatic latent image is formed. The magnetic developer 2 is attracted on the permanent magnetic member 4 and is then transferred to a developing region opposite to the image-bearing member 3, where the electric field of the electrostatic latent image formed on the image-bearing member 3 causes the toner in the magnetic developer 2 to be deposited on the image-bearing member 3 , thereby developing the electrostatic latent image.

The developed toner image is transferred to the transfer sheet 10 by the transfer roller 7, moved in the direction shown by the arrow in the figure, and then fixed. After the transfer, residual toner remaining on the image-bearing member 3 is scraped away by the blade 9 that contacts the surface of the image-bearing member 3 and slides thereon, and collected in the cleaning device 8.

In this image forming method, however, magnetic carriers in the magnetic developer 2 may attach to the image-bearing member 3 together with the toner, and undesired conditions may occur if the magnetic carriers pass through the blade 9 and reach the charging roller 6. That is, since the magnetic carriers are generally conductive, leakage may occur when the magnetic carriers contact the charging roller 6 while remaining on the image-bearing member 3, thereby preventing the surface of the image-bearing member 3 from being charged uniformly, resulting in defects in the image such as noises or black spots, or even ignition of the sheet in extreme cases.

If the pressure of the blade 9 against the image-bearing member 3 is increased to completely remove the remaining magnetic toner, the surface of the image-bearing member 3 may be damaged to reduce its potential life. In addition, the disadvantage that the magnetic carriers attach to the photosensitive drum 3 is more apparent in structures with the cleaning device 8 omitted in response to the recent strong demands for the miniaturization of the apparatus.

SUMMARY OF THE INVENTION

It is an object of this invention to provide an image formation methods capable of solving the above problems and preventing magnetic carriers from attaching to the surface of an image-bearing member in order to form high-quality images.

To achieve the above object, this invention provides an image information method comprising the steps of using a roller charging means to uniformly charge the surface of a movable image-bearing member, carrying out image exposure to form an electrostatic latent image on the image-bearing member, developing the image using a magnetic developer comprising two components: toner and magnetic carriers, and using a roller transfer means to transfer a toner image obtained onto a transfer member, wherein a magnetic developer conveying means comprises a permanent magnetic member formed rotatably like a cylinder with a plurality of magnetic poles provided on its surface and wherein the magnetic carriers constituting the magnetic developer are formed so as to have a volume resistivity of $10^{10}$ Ω.cm or more.

In this invention, the roller charging means and roller transfer means each comprise, for example, a metal shaft with a conductive elastic layer (for example, urethane, butadiene, or ethylene propylene rubber which includes conductive particles such as carbon black; the volume resistivity is preferably $10^{10}$ Ω.cm or less) formed thereon.

The permanent magnetic member according to this invention may comprise a ferrite magnet or a resin bonded magnet mainly comprising magnetic powders and a resin material. The permanent magnetic member may be the magnet formed integrally on the outer circumference of a shaft like a roller or may be formed entirely of a magnet material including the shaft. The permanent magnet member, however, must be formed integrally without circumferential or axial joints to prevent nonuniform development. A conductive layer (for example, a non-magnetic metal such as Cu, SUS 304, or Ni) may be formed on the surface of the permanent magnet member.

Magnetic poles of alternatively different polarities are disposed circumferentially on the surface of the permanent magnetic member at a very small interval, so the surface magnetic flux density decreases with increasing number of magnetic poles. To prevent the magnetic developer from scattering, the surface magnetic flux density of the permanent magnetic member is preferably 50 G (gauss) or more, and also 1,200 G or less so as to allow the toner to easily deposite on stick to an electrostatic latent image formed on the surface of the image-bearing member. The number of magnetic poles is preferably 8 to 60 corresponding to the surface magnetic flux density of 50 to 1,200 G. The surface magnetic flux density is more preferably within the range of 100 to 800 G.

As the number of magnetic poles increases, magnetic fields formed around the permanent magnet member become smaller, and a smaller amount of magnetic developer is attracted on the surface of the permanent magnet member. This causes a magnetic developer layer formed on the surface of the permanent magnet member to have a nonuniform thickness. The permanent magnet member must thus be rotated at a high speed to prevent such an undesired condition. If, however, the rotational speed of the permanent magnet member is too high, the drive torque may increase or the carriers constituting the magnetic developer may be worn. If the rotational speed is too low, the image may have a nonuniform density. Consequently, the peripheral speed of the permanent magnetic member Vm (mm/sec) is preferably set as large as to 1~ten times of the peripheral speed of the image-bearing member Vp (mm/sec), and more preferably twice to sixth times the same value.

If the outer diameter of the permanent magnet member and the number of magnet poles provided on the surface are referred to as D (mm) and M, respectively, D, M, and Vm are preferably set so that the value of h (mm) represented by the following equation is smaller than two.

$$h=(\pi.D.Vp)/(M.Vm)$$

(h) is a pitch that corresponds to the number of times that the magnetic poles on the permanent magnetic member are opposed to the surface of the image-bearing member in a unit time. If (h) is 2 mm or longer, development will be significantly nonuniform. Thus, (h) should preferably be shorter than 2 mm, and more preferably 1 mm or shorter. In this case, the number of magnetic poles M on the permanent magnetic member and the peripheral velocity Vm may be increased to reduce the value of (h). Too large a number of magnetic poles M, however, may reduce the surface magnetic flux density to cause the magnetic developer to scatter easily, and too high a peripheral velocity Vm may cause the above disadvantages, so the value of (h) is preferably 0.4 to 1.0 mm from a practical point of view.

If a doctor gap (t) is provided between the surface of the permanent magnet member and the tip of the doctor blade, the difference between the gap (t) and the gap (g) between the permanent magnet member and the image-bearing member is preferably 0.2±0.15 mm from the view of the image quality. (t) may be zero by allowing the doctor blade to contact the surface of the permanent magnet member. In this case, the doctor blade may be formed of an elastic material such as an SK material or a non-magnetic material such as SUS304 or phosphor bronze like an elastic blade, with its one end fixed to the developer vessel and its other end contacting the surface of the permanent magnet member.

If the permanent magnet member according to this invention is formed of only a semi-conductive or insulating material, a bias voltage is preferably applied from the doctor blade. In this case, the doctor blade may be formed of a conductive material such as metal.

If an AC voltage is superposed on a DC voltage, it preferably has a relatively low frequency of 20 KHz or less, and more preferably 10 KHz or less. In addition, the peak-to-peak value $V_{p-p}$ is preferably within the range of 100 to 2,000 V, and more preferably 200 to 1,200 V.

The carriers constituting the magnetic developer may comprise magnetic particles 10 to 150 pm in average particle size and 30 emu/g or more in magnetization $\sigma_{1000}$ measured in a magnetic field of 1,000 Oe (binder particles in which magnetic powders are dispersed in a resine, iron powders, ferrite or magnetite). A magnetization $\sigma_{1000}$ of smaller than 30 emu/g is not preferable because the carriers attach easily on the image-bearing member under such a condition. It is also preferable that the carriers be in particular iron powders and be flat rather than spherical because such carriers allow toner to be charged better.

The magnetic carriers preferably have a volume resistivity of $10^{10}$ Ω.cm or more. That is, when the volume resistivity is less than $10^{10}$ Ω.cm, the magnetic carriers easily attach to the image-bearing member to degrade the image quality, thereby causing leakage in the roller charging means as well as unstable charging of the toner during development.

For example, the surface of the magnetic particles may be covered with resin to allow the magnetic carriers to have a volume resistivity of $10^{10}$ Ω.cm or more. Various additives (charge-controlling agents or antioxidants) may be added to the resin.

Such a resin material may be a homopolymer or copolymer obtained by polymerizing monomers including styrene such as P-chlorostyrene or methylstyrene; halogenated vinyl such as vinyl chloride, vinyl bromide, or vinyl fluoride; vinyl ester such as vinyl acetate, propionic acid type vinyl, or vinyl benzoate; α-aliphatic methylene monocarboxylic acid type ester such as methyl acrylate, ethyl acrylate, n-butyl acrylate, isobutyl acrylate, dodecyl acrylate, n-octyl acrylate, 3-chloroethyl acrylate, phenyl acrylate, α-methyl chloroacrylate, or butyl methacrylate; vinyl ether such as acrylonitrile, methacrylonitrile, acrylamide, vinylmethylether, vinylisobutyleter, or vinylethylether, and vinyl ketone such as vinylethylketon, vinylhexylketone, or methylisopropenylketone, or may be fluorine contained resin such as exposy resin, silicone resin, rosin-modified phenolformalin resin, sellulose resin, polyether resin, polyvinylbutyral resin, polyester resin, styrene-butadiene resin, polyurethane resin, polycarbonate resin, or ethylene tetrafluoride, or their mixture.

Among the above compounds, styrene-acrylic resin, silicone resin, epoxy resin, styrene-butadiene resin and cellulose resin are particularly useful.

For example, the carriers for the developer according to this invention can be manufactured as follows. The resin is first dissolved as appropriate. A solvent for the resin may be, for example, benzene, toluene, xylene, methylethylketone, tetrahydrofuran, chloroform, or hexane. The resin may be used as an emulsion. The resin solution or emulsion is sprayed against the surface of the magnetic carriers in such a way that it can be covered uniformly with the solution. To obtain a uniform covering, the magnetic carriers are preferably allowed to be constantly fluidized. For this purpose, a spray dryer or fluidized bed is desirably used. The resin solution is sprayed in the atmosphere at about 200° C. or lower, preferably within the range of about 100° to 150° C., and the solvent is then removed quickly. During this process, the resin covering is dried. The resin emulsion is sprayed within the range of the ordinary temperature to 100° C. so as to cause the resin to be melted and coated on the surface of the magnetic carriers.

It is particularly preferable that the carriers have an average particle size of 10 to 50 μm. This is because the toner is sufficiently charged when the average particle size is 50 μm or smaller, whereas the carriers attach easily on the image-bearing member when the average particle size is smaller than 10 μm.

The carriers may be a mixture of two or more types of magnetic particles listed above. For example, magnetic particles of a large particle size with an average particle size of 60 to 120 μm may be mixed with magnetic particles of a small particle size with an average particle size of 10 to 50 μm or binder magnetic particles of a small particle size with an average particle size of 10 to 50 μm. The mixing ratio may be determined with the size and magnetic characteristics of the magnetic particles taken into consideration.

The toner to be mixed with the carriers may be magnetic or non-magnetic, but is preferably insulated and has a volume resistivity of $10^{14}$ Ω.cm or more to improve transferability. It is also preferably charged easily by means of friction between the carriers and doctor blade (the triboelectrostatic charge is preferably 10 μc/g or more in terms of the absolute value). In addition, the toner is preferably formed so as to have an average particle size of 5 to 10 μm to obtain very fine images. The mixing ratio of the toner in the magnetic developer is preferably 10 to 90 wt. % for magnetic toner and 5 to 60 wt. % for non-magnetic toner.

As in ordinary toner, the toner comprises binding resin (for example styrene-acrylic polymer or polyester resin) and a coloring agent (for example carbon black; but this need not be added if magnetite is used as the magnetic powders described below) as essential components, and contain (internal and/or external addition) magnetic powders (for example magnetite or soft ferrite), a charge controlling agent (for example nigrosine or azo pigment containing metal (such as Cr)), a release agent (for example polyolefine), and a fluidizing agent (for example hydrophobic silica) as optional components. If magnetic toner is used, 70 wt. % or less of magnetic powders are preferably used because a large amount of powders are not fixed easily. Color toner may be used by selecting coloring agents as appropriate.

A vibrating sample magnetometer (VSM-3 manufactured by Toei Kogyo Inc.) was used to measure the value of magnetization, and a particle size analyzer (Coaltar Counter Model TA-II manufactured by Coaltar Electronics Inc.) was used to measure the average particle size (the volume).

The value of the volume resistivity was obtained by weighing an appropriate amount of sample (10 mg or so), filling it into a Teflon (a trade name) cylinder 3.05 mm in inner diameter which is an improved dial guage, subjecting the cylinder to a load of 0.1 kg, applying an electric field of D.C. 100 V/cm thereto for the magnetic carriers or of D.C. 4,000 V/cm for the toner, and then performing required measurements. An insulation resistant tester (4329A manufactured by Yokogawa-Hewlett-Packard, Ltd.) was used to measure the resistance. The triboelectrostatic charge was determined by sufficiently stirring a developer with a toner concentration of 5 wt. %, blowing the toner at a blow pressure of 1.0 kgf/cm$^2$, and using blowoff powder charge measuring equipment (TB-200 manufactured by Toshiba Chemical Inc.) to perform required measurements.

The above construction can form a magnetic brush directly over the outer surface of the permanent magnet member without a sleeve which acts as a magnetic developer conveying means, and cause the brush to slide on an electrostatic latent image on the image-bearing to scrub and develop it, thereby preventing the magnetic carriers from attach on the image-bearing member to form high-quality images free from defects such as black spots.

DESCRIPTION OF THE PREFERRED EMBODIMENTS

Figure 1:
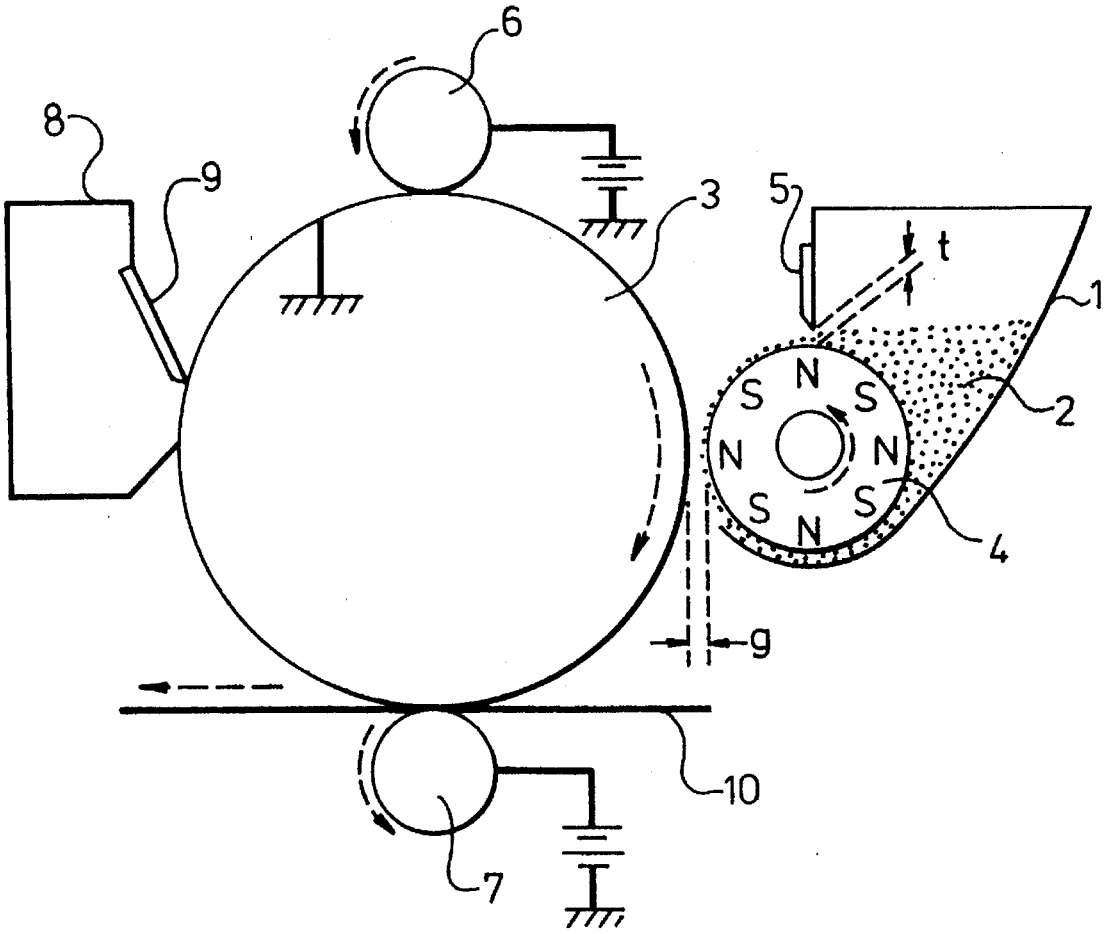
FIG. 1 describes the integral part of an example of a sleeveless development means.

This invention is primarily applicable to a sleeveless development means shown in FIG. 1 and having no cleaning device 8 but also applicable to a similar development means with a cleaning device 8. An image-bearing device 3 (a photosensitive drum) is disposed so as to rotate in the direction shown by the arrow in FIG. 1. After the surface of the image-bearing member 3 has been charged uniformly by a roller charging means 6, image exposure is carried out to form an electrostatic image on the image-bearing member 3. The electrostatic latent image is developed using a magnetic developer 2 comprising two components: toner and magnetic carriers. In this development process, the magnetic developer is directly attracted on the surface of a permanent magnet member 4 formed rotatably like a cylinder with a plurality of magnetic poles symmetrically provided on its surface, and the permanent magnet member 4 is rotated in the direction shown by the arrow in FIG. 1 to deliver the magnetic developer to a developing region opposite to the electrostatic latent image on the image-bearing member 3, thereby transferring the toner in the magnetic developer onto the electrostatic latent image. The toner image obtained is transferred to a transfer sheet 10 such as plain paper by a roller transfer means 7.

gap (g) of 0.4 mm and a doctor gap (t) of 0.3 mm maintained.

The charging roller 6 was formed by coating urethane foam rubber (to which a conductive agent is added and which has a volume resistivity of $10^5$ Ω.cm, a hardness Hs of 30°, and a thickness of 2 mm) on the outer circumference of a shaft of SUS304 so as to have an outer diameter of 20 mm. The transfer roller 7 was formed by coating ethyleneepropylene rubber 80° in hardness Hs and 2 mm in thickness on the outer circumference of the shaft of SUS304 so as to have an outer diameter of 20 mm, and pressed against the image-bearing member 3.

Table 1 shows the results of continuous development under the above developing conditions using the developing means in FIG. 1 and a magnetic developer comprising a mixture of magnetic carriers with a volume resistivity varied by varying the amount of resin added and magnetic toner of a varying concentration, wherein every 1000th developed sheet (A4-sized) was evaluated.

TABLE 1

| No | Volume resistivity (Ω · cm) | Amount of resin added (wt. %) | Toner concentration (wt. %) | Image Density | Fogging | Defects (black spots) |
|---|---|---|---|---|---|---|
| 1 | $10^6$ | 0.5 | 20 | 1.45 | No fogging | An extremely large number of black spots |
| 2 | $10^8$ | 1.0 | 20 | 1.42 | No fogging | A large number of black spots |
| 3 | $10^{10}$ | 2.0 | 20 | 1.40 | No fogging | No black spots |
| 4 | $10^{12}$ | 2.5 | 20 | 1.37 | No fogging | No black spots |
| 5 | $10^{14}$ | 3.0 | 20 | 1.37 | No fogging | No black spots |
| 6 | $10^{12}$ | 2.5 | 10 | 1.35 | No fogging | No black spots |
| 7 | $10^{12}$ | 2.5 | 40 | 1.37 | No fogging | No black spots |
| 8 | $10^{12}$ | 2.5 | 60 | 1.39 | No fogging | No black spots |

Magnetic toner 10 μm in average particle size, 4 to 16 μm in particle size distribution, $10^{15}$ Ω.cm in volume resistivity, and −23 μc/g in triboelectrostatic charge was prepared. Styrene-n butylmethacrylate, magnetite (EPT 500 by Toda Kogyo Corp.), polypropylene (TP32 manufactured by Sanyo Chemical Co., Ltd.), and a charge controlling agent (Bontron E-81 manufactured by Orient Chemical Industries.) were mixed in the compounding ratio of 45:50:3:2 in terms of the weight percent, with 0.5 wt. % of external additive (Aerogel R972 manufactured by Nippon Aerogel Co., Ltd.) added to the particles formed of the above compounds.

The magnetic carriers comprised flat iron powders 30 μm in average particle size, 10 to 50 μm in particle size distribution, and 120 emu/g in magnetization $\sigma_{1000}$ at 1,000 Oe, and silicone resin was coated on the surface of the carriers to adjust the volume resistivity.

The photosensitive drum 3 was formed of OPC with a surface potential of −700 V and a peripheral speed of 30 mm/sec. The permanent magnet member 4 was formed of a ferrite magnet (YBM-3 manufactured by Hitachi Metals Ltd.) so as to have an outer diameter of 20 mm, 16 poles, and a surface flux density of 500 G, and a D.C. bias voltage of −550 V was applied to a doctor blade 5 with a developing As is apparent from Table 1, for sheets No. 1 and 2, the magnetic carriers attach to the surface of the image-bearing member 3 due to their low volume resistivity, causing leakage in the charging roll 6 and defects (black spots) in the image, thus resulting in degraded image quality. No defects, however, were found on sheets No. 3 to 8, and high-quality images were formed over a wide range of toner concentration from 10 to 60 wt. %.

Next, non-magnetic toner 8.5 μm in average particle size, 10 to 70 μm in particle size distribution, $5\times10^{14}$ Ω.cm in volume resistivity, −29 μc/g in triboelectrostatic charge was prepared. Polyester (KTR2150 manufactured by Kao Inc.), carbon black (#44 manufactured by Mitsubishi Chemical Industries Ltd.), polypropylene (TP32 manufactured by Sanyo Chemical Co., Ltd.), and a charge controlling agent (Kayacharge T2N manufactured by Nihon Kasei Inc.) were mixed in the compounding ration of 87:10:2:1 in terms of the weight percent, with 0.5 wt. % of external additive (Aelogel R972 manufactured by Nippon Aerogel Co., Ltd.) added to the particles formed of the above compounds.

The magnetic carriers comprised flat iron powders 50 μm in average particle size, 10 to 70 μm in particle size distribution, and 120 emu/g in magnetization $\sigma_{1000}$ at 1,000 Oe, and silicone resin was coated on the surface of the carriers to adjust the volume resistivity, as described above.

The image-bearing member 3 was formed of OPC with a surface potential of −650 V and a peripheral speed of 30 mm/sec. The permanent magnet member 4 was formed of a ferrite magnet (YBM-3 manufactured by Hitachi Metals Ltd.) so as to have an outer diameter of 20 mm, 32 poles, and a surface magnetic flux density of 350 G, and a D.C. bias voltage of −550 V was applied to the doctor blade 5 with a developing gap (g) of 0.4 mm and a doctor gap (t) of 0.25 mm maintained.

Table 2 shows the results of continuous development under the above conditions using a magnetic developer comprising a mixture of magnetic carriers with a volume resistivity varied as in the above embodiment and non-magnetic toner, wherein every 1,000th developed sheet (A4-sized) was evaluated.

TABLE 2

| No | Volume resistivity (Ω · cm) | Amount of resin added (wt. %) | Toner concentration (wt. %) | Image density | Fogging | Defects (black spots) |
|---|---|---|---|---|---|---|
| 9 | $10^7$ | 0.5 | 30 | 1.42 | No fogging | A large number of black spots |
| 10 | $10^9$ | 1.0 | 30 | 1.40 | No fogging | A large number of black spots |
| 11 | $10^{11}$ | 2.0 | 30 | 1.38 | No fogging | No black spots |
| 12 | $10^{13}$ | 3.0 | 30 | 1.37 | No fogging | No black spots |

As is apparent from Table 2, the images on sheets No. 9 and 10 had some defects (black spots) and degraded quality due to the low volume resistivity of the magnetic carriers, whereas the images on sheets No. 11 and 12 had no such defects but high quality.

With the above configuration and operation, this invention can produce the following effects.

(1) Since the magnetic carriers constituting the magnetic developer have a high volume resistivity, this invention can prevent the carriers from attaching to the surface of the image-bearing member to carry out high-quality image formation without causing leakage in the charging means or defects in images.

(2) Since the developing means comprises only a permanent magnet member, this invention can omit a sleeve to miniaturize the developing device and image forming device.

(3) Since the magnetic developer is attracted on the surface of permanent magnet member, this invention can improve the transportability of the developer, stability of the shape of the magnetic brush, and developability to provide high-quality images.

(4) When a magnetic developer comprising two components, this invention can set the toner concentration within a wide range to enable the toner concentration controlling means to be omitted, thereby serving to miniaturize the overall apparatus.

What is claimed is:

1. An image forming method comprising the steps of:

charging a surface of a movable image-bearing member uniformly by using a roller charging means;

forming an electrostatic latent image on the image-bearing member by carrying out an image exposure;

delivering a magnetic developer which is attracted onto a surface of a sleeveless permanent magnetic member to a developing region located opposite to the electrostatic latent image formed on the image-bearing member, the sleeveless permanent magnetic member being formed with a plurality of magnetic poles provided on its surface and having a cylinder shape;

developing the electrostatic latent image using the magnetic developer comprising a toner and magnetic carriers, the magnetic carriers having a volume resistivity of $10^{10}$ Ω.cm or more; and transferring a toner image onto a transfer sheet by using a roller transfer means.

2. The image forming method according to claim 1, wherein the roller charging means and the roller transfer means each comprises a metal shaft and an outer elastic layer with a volume resistivity of $10^6$ Ω.cm or less.

3. The image forming method according to claim 1, wherein 8 to 60 magnetic poles of alternatively different polarities are provided circumferentially on the surface of the sleeveless permanent magnet member so that the surface has a magnetic flux density of 50 to 1,200 gauss.

4. An image forming method comprising the steps of:

charging a surface of a movable image-bearing member uniformly by using a roller charging means;

forming an electrostatic latent image on the image-bearing member by carrying out an image exposure;

delivering a magnetic developer which is attracted onto a surface of a permanent magnetic member to a developing region located opposite to the electrostatic latent image formed on the image-bearing member, the permanent magnetic member being formed with a plurality of magnetic poles provided on its surface and having a cylinder shape;

developing the electrostatic latent image using the magnetic developer comprising a toner and magnetic carriers, the magnetic carriers having a volume resistivity of $10^{10}$ Ω.cm or more; and transferring a toner image onto a transfer sheet by using a roller transfer means;

wherein if the peripheral speed of the image-bearing member is Vp (mm/sec), if the peripheral speed, outer diameter, and number of magnetic poles of the permanent magnetic member are referred to as Vm (mm/sec), D (mm), and M, respectively, a pitch (h) calculated by the formula $h=(\pi.D.Vp)/(M.Vm)$ is in the range of 0.4 to 2 mm.

* * * * *